US006513179B1

(12) United States Patent
Pan

(10) Patent No.: US 6,513,179 B1
(45) Date of Patent: Feb. 4, 2003

(54) PILLOW

(76) Inventor: Chien-Liang Pan, No. 380, ChangHsi Road, Sec. 1, Tainan (TW)

( * ) Notice: Subject to any disclaimer, the term of this patent is extended or adjusted under 35 U.S.C. 154(b) by 0 days.

(21) Appl. No.: 10/074,461

(22) Filed: Feb. 11, 2002

(51) Int. Cl.[7] ..... A47G 9/00
(52) U.S. Cl. ..... 5/636; 5/640
(58) Field of Search ..... 5/636, 637, 639, 5/640, 643, 655.9, 657, 953; D6/601

(56) References Cited

U.S. PATENT DOCUMENTS

| | | | | | |
|---|---|---|---|---|---|
| 2,700,779 | A | * | 2/1955 | Tolkowsky | 5/636 X |
| 3,243,828 | A | * | 4/1966 | McCarty | 5/636 |
| 3,263,246 | A | * | 8/1966 | Towery | 5/639 |
| D214,302 | S | * | 6/1969 | Barber | D6/601 |
| 3,694,831 | A | * | 10/1972 | Treace | 5/638 |
| D248,141 | S | * | 6/1978 | Forsland | D6/601 |
| 4,494,261 | A | * | 1/1985 | Morrow | 5/636 |
| 4,731,891 | A | * | 3/1988 | Scheurer et al. | 5/636 |
| 4,777,855 | A | * | 10/1988 | Cohen | 5/636 X |
| D306,112 | S | * | 2/1990 | Forsland | 5/637 X |
| D306,245 | S | * | 2/1990 | Akhtarekhavari | D6/601 |
| 4,916,765 | A | * | 4/1990 | Castronovo, Jr. | 5/640 |
| D308,311 | S | * | 6/1990 | Forsland | D6/601 |
| D308,455 | S | * | 6/1990 | Jenney | 5/636 X |
| 5,163,194 | A | * | 11/1992 | Dixon | 5/639 X |
| 5,457,832 | A | * | 10/1995 | Tatum | 5/636 |
| 5,471,691 | A | * | 12/1995 | Ryndak | 5/645 |
| 5,533,218 | A | * | 7/1996 | Fahy | 5/636 |
| D376,288 | S | * | 12/1996 | Antonian | D6/601 |
| 5,661,862 | A | * | 9/1997 | Ryndak | 5/636 |
| 5,682,633 | A | * | 11/1997 | Davis | 5/645 X |
| 5,732,427 | A | * | 3/1998 | Parnham | 5/640 |
| 5,809,594 | A | * | 9/1998 | Isogai | 5/645 |
| D402,150 | S | * | 12/1998 | Wurmbrand et al. | D6/601 |
| 5,926,879 | A | * | 7/1999 | Davis | 5/636 |

FOREIGN PATENT DOCUMENTS

| | | | | |
|---|---|---|---|---|
| DE | 2009792 A | * | 11/1970 | 5/636 |
| DE | 8101524 | * | 11/1981 | 5/636 |

* cited by examiner

*Primary Examiner*—Robert G. Santos
(74) *Attorney, Agent, or Firm*—Pro-Techtor International Services

(57) ABSTRACT

A pillow is constructed to include a hollow body of sponge, the pillow body having an open chamber longitudinally extended through two opposite vertical lateral sides thereof, and a support of foamed plastics inserted into the open chamber of the pillow body and detachably secured thereto by tie cords for supporting the pressure of the head resting on the pillow body. The front side of the pillow body is curved outwards, when put under the user's head, forming a smoothly arched protruding supporting portion that supports the user's neck.

3 Claims, 6 Drawing Sheets

PILLOW

BACKGROUND OF THE INVENTION

1. Field of the Invention

The present invention relates to a pillow and, more particularly, to such a pillow, which supports the user's head and neck and, provides good ventilation for quick dissipation of heat.

2. Description of the Related Art

Everyone spends about one third of the whole life in sleeping. A good sleeping helps one recover from fatigue. People tend to get sick when suffering insomnia. Frequently. Various orthopedically engineered pillows are commercially available for helping people sleeping. FIG. 1 illustrates a pillow according to the prior art. This structure of pillow is shaped like a saddle, having a relatively lower middle part and two relatively higher side parts at two sides of the middle part. The top of the middle part curves inwards in transverse direction from the two sides toward the mid point. This structure of pillow is still not satisfactory in function. The drawbacks of this structure of pillow are numerous as outlined hereinafter.

1. The pillow is molded from foamed material in integrity. It does not fit all people of different weights.
2. The height of the pillow is not adjustable to fit different users.
3. When put the saddle-like pillow under the head, the user's head, neck and shoulders ache or become stiff soon because the compressive strength of the pillow is not adjustable.
4. The integrated body of the pillow does not provide ventilation for dissipation of heat when put under the user's head.

SUMMARY OF THE INVENTION

The present invention has been accomplished to provide a pillow, which eliminates the aforesaid drawbacks.

It is one object of the present invention to provide a pillow, which can be conveniently adjusted to fit different users.

It is another object of the present invention to provide a pillow, which supports the head and neck of the user lying on the back, preventing the neck from suspending in the open air.

It is still another object of the present invention to provide a pillow, which supports the head of the user lying on the side, preventing hard pressing of the user's body on the hand.

It is still another object of the present invention to provide a pillow, which effectively buffers the pressure of the head resting on it.

It is still another object of the present invention to provide a pillow, which provides good ventilation for quick dissipation of heat.

According to one aspect of the present invention, the pillow comprises a hollow body of sponge, the pillow body having an open chamber longitudinally extended through two opposite vertical lateral sides thereof, and a support of foamed plastics inserted into the open chamber of the pillow body and detachably secured thereto by tie cords for supporting the pressure of the head resting on the pillow body. The front side of the pillow body is curved outwards, when put under the user's head, forming a smoothly arched protruding supporting portion that supports the user's neck.

According to another aspect of the present invention, the open chamber provides a ventilation space for ventilation and dissipation of heat after installation of the support in the open chamber.

According to still another aspect of the present invention, the support has a recessed middle support portion, which supports the pressure of the head of the user lying on the back, and two side support portions disposed at two sides of the recessed middle support portion at a relatively higher elevation, which stop the user's head from displacement.

DETAILED DESCRIPTION OF THE PREFERRED EMBODIMENT

Figure 1:
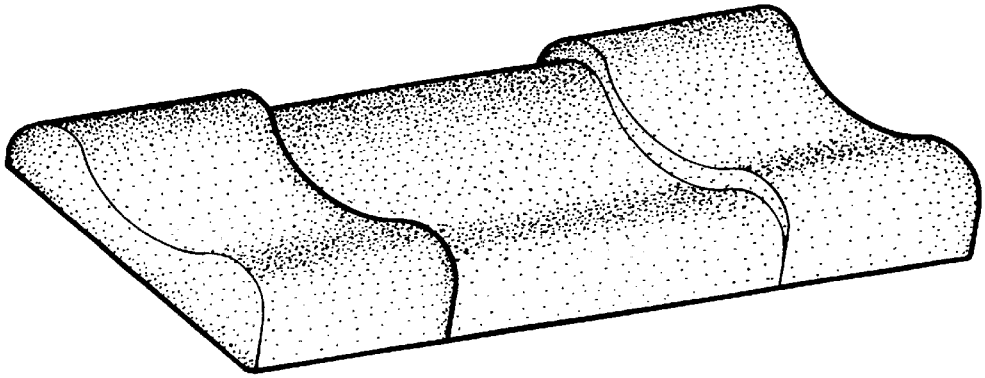
Fig.1 (Prior Art)
FIG. 1 is an elevational view of a pillow according to the prior art.
Figure 2:
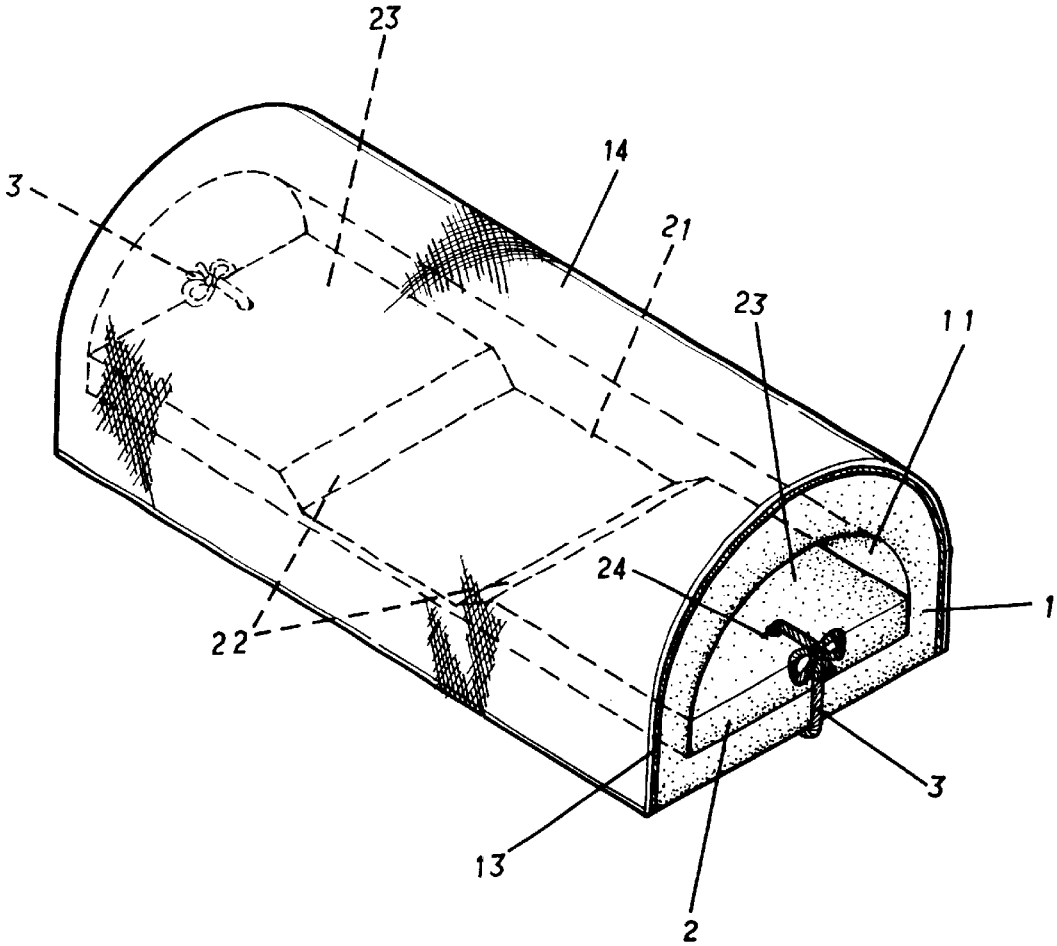
FIG. 2 is a perspective view of a pillow according to a first embodiment of the present invention.
Figure 3:
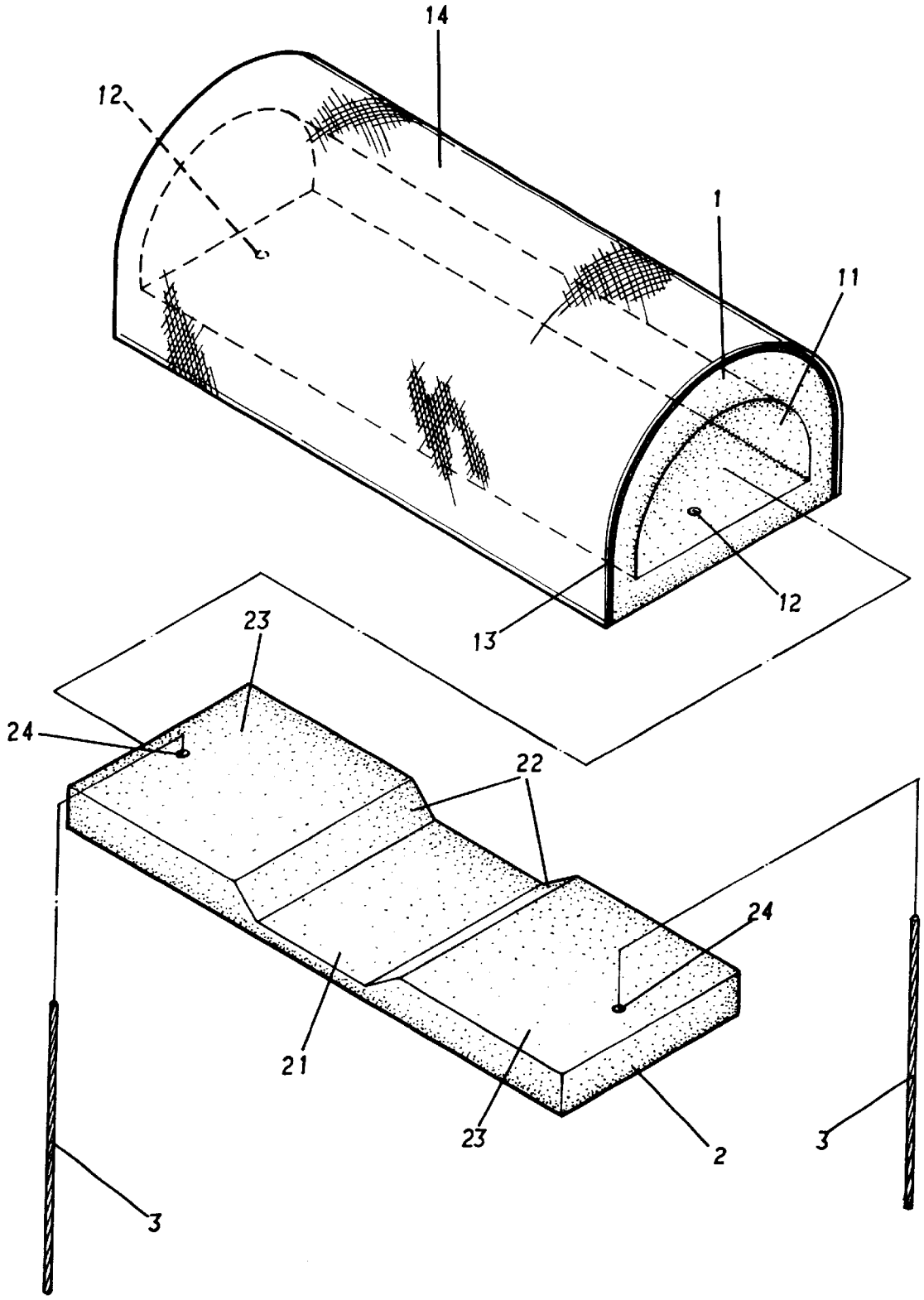
FIG. 3 is an exploded view of the pillow according to the first embodiment of the present invention.

Referring to FIGS. 2 and 3, a pillow in accordance with the present invention is generally comprised of a pillow body 1 and a support 2. The pillow body 1 is made of sponge, having an open chamber 11 of semicircular cross section longitudinally extended through the two opposite vertical lateral sidewalls thereof, two bottom through holes 12 through the bottom sidewall thereof, a layer of flexible heat insulation material 13 covered over the periphery, and a covering of meshed fabric 14 covered over the layer of flexible heat insulation material 13. The support 2 is made of foamed plastics, having a recessed middle support portion 21, two flat side support portions 23 disposed at two sides of the recessed middle support portion 21, two slopes 22 respectively downwardly sloping from the flat side support portions 23 to the two sides of the recessed middle support portion 21, and two through holes 24 respectively extended through top and bottom sides of the flat side support portions 23 corresponding to the through holes 12 of the pillow body 1.

Referring to FIG. 2 again, the support 2 is inserted into the longitudinally extended open chamber 11, and two tie cords 3 are respectively fastened to the through holes 24 of the support 2 and the through holes 12 of the pillow body 1 to secure the support 2 to the pillow body 1 inside the longitudinally extended open chamber 11.

Figure 4:
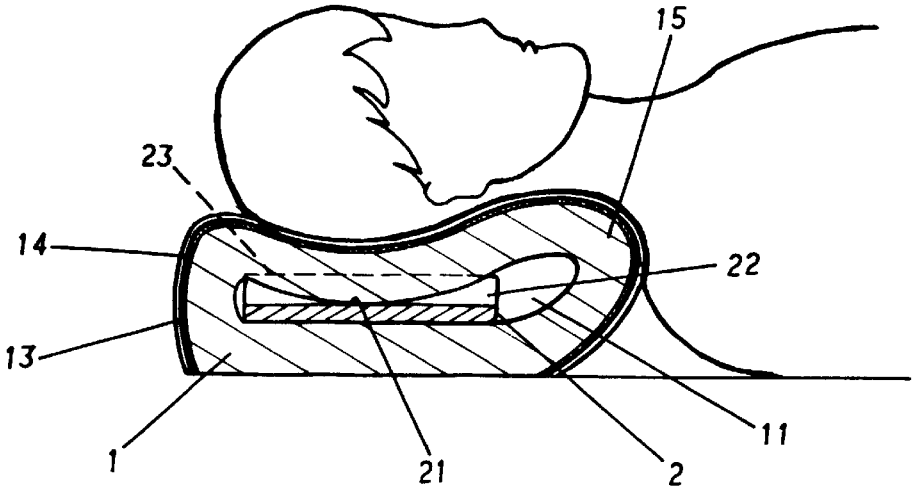
FIG. 4 is a sectional view showing one application example of the pillow according to the first embodiment of the present invention.
Figure 5:
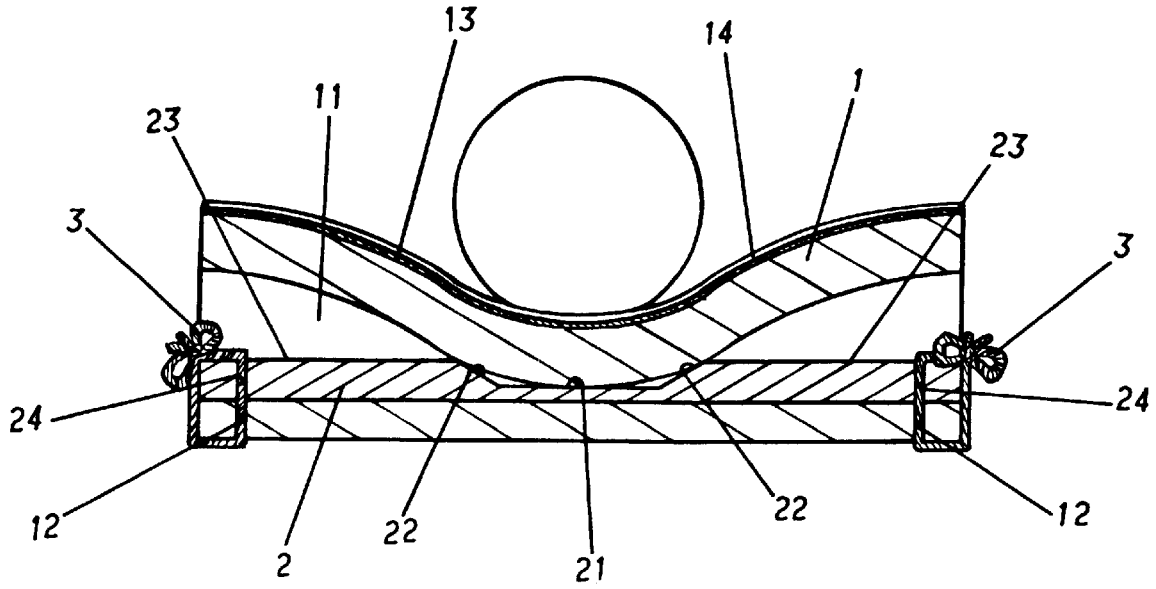
FIG. 5 is a sectional view of FIG. 4 viewed from another direction.
Figure 6:
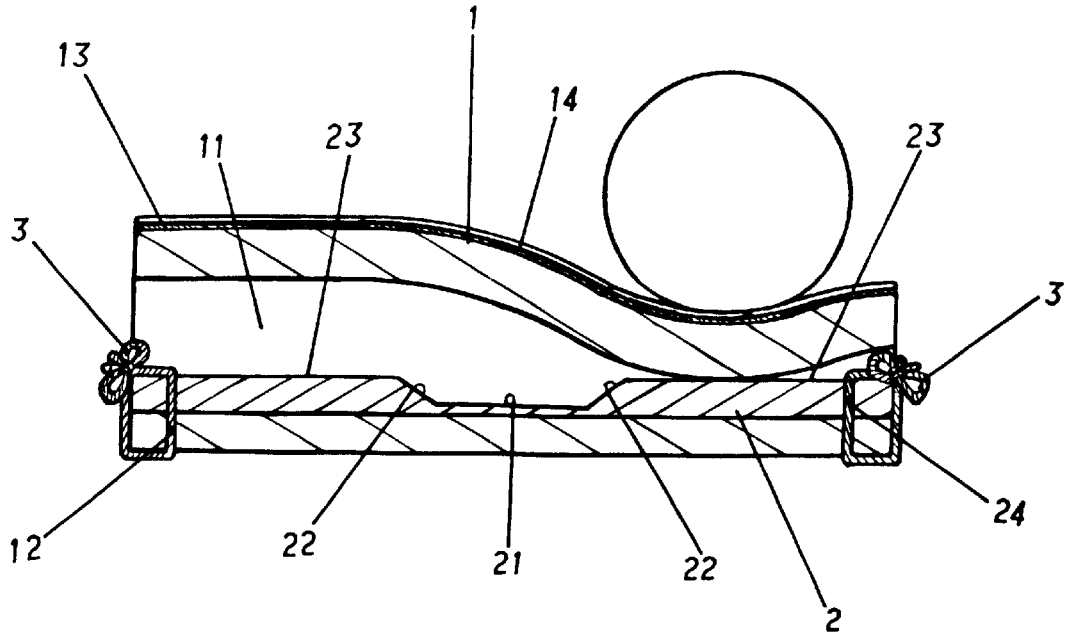
FIG. 6 is a sectional view showing another application example of the pillow according to the first embodiment of the present invention.

When lying on the back with the head rested on the pillow body 1, the top side of the pillow body 1 is curved downwards and supported on the recessed middle support portion 21 between the slopes 22 (see FIG. 5), and the front side of the pillow body 1 is curved outwards forming a smoothly arched protruding supporting portion 15, which supports the user's neck (see FIG. 4), preventing the user's neck from suspending in the air. When lying on the side, with the head rested on the pillow body 1, the smoothly arched protruding supporting portion 15 supports the user's neck, and the corresponding flat side support portion 23 of the support 2 supports the weight of the user's head at a relatively higher elevation, preventing hard pressing of the user's body on the hand (see FIGS. 6 and 7).

Figure 8:
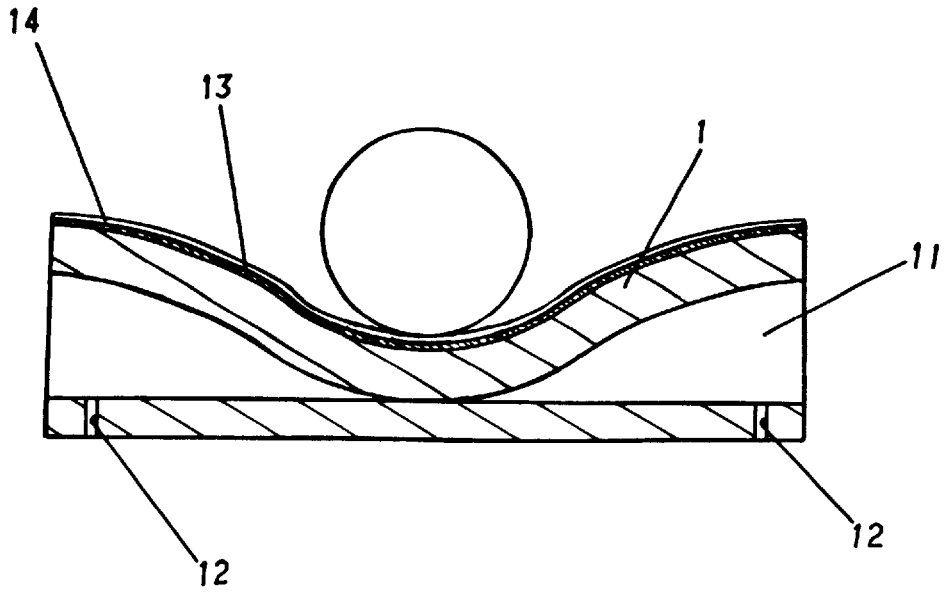
FIG. 8 is a sectional view showing an application example of the pillow body without the support according to the first embodiment of the present invention.

Referring to FIG. 8, the pillow body 1 may be independently used for supporting the head of a young child without the aforesaid support 2.

Figure 10:
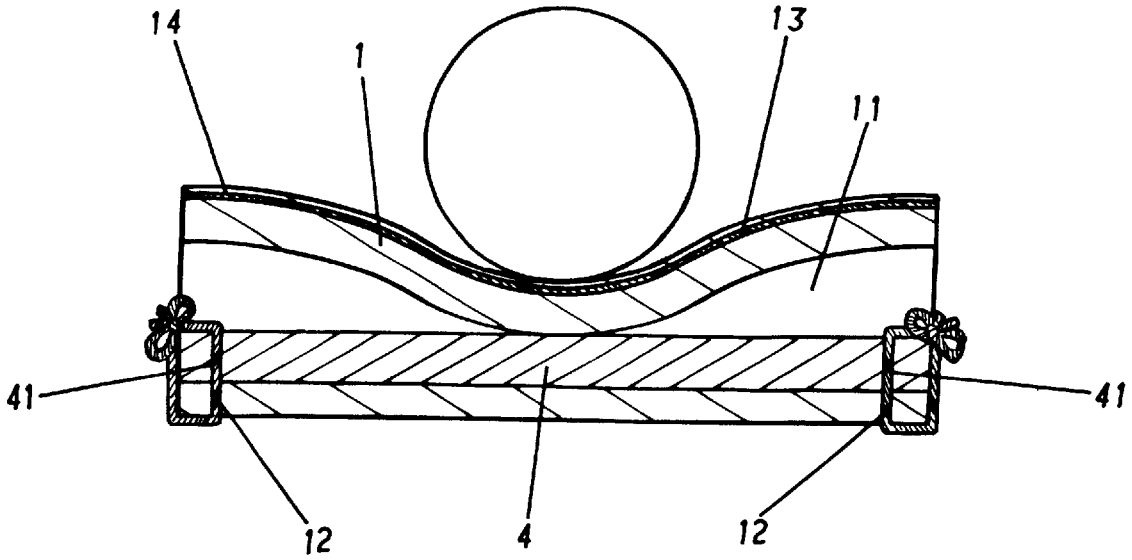
FIG. 10 is a sectional view showing an application example the pillow according to the second embodiment of the present invention.
Figure 9:
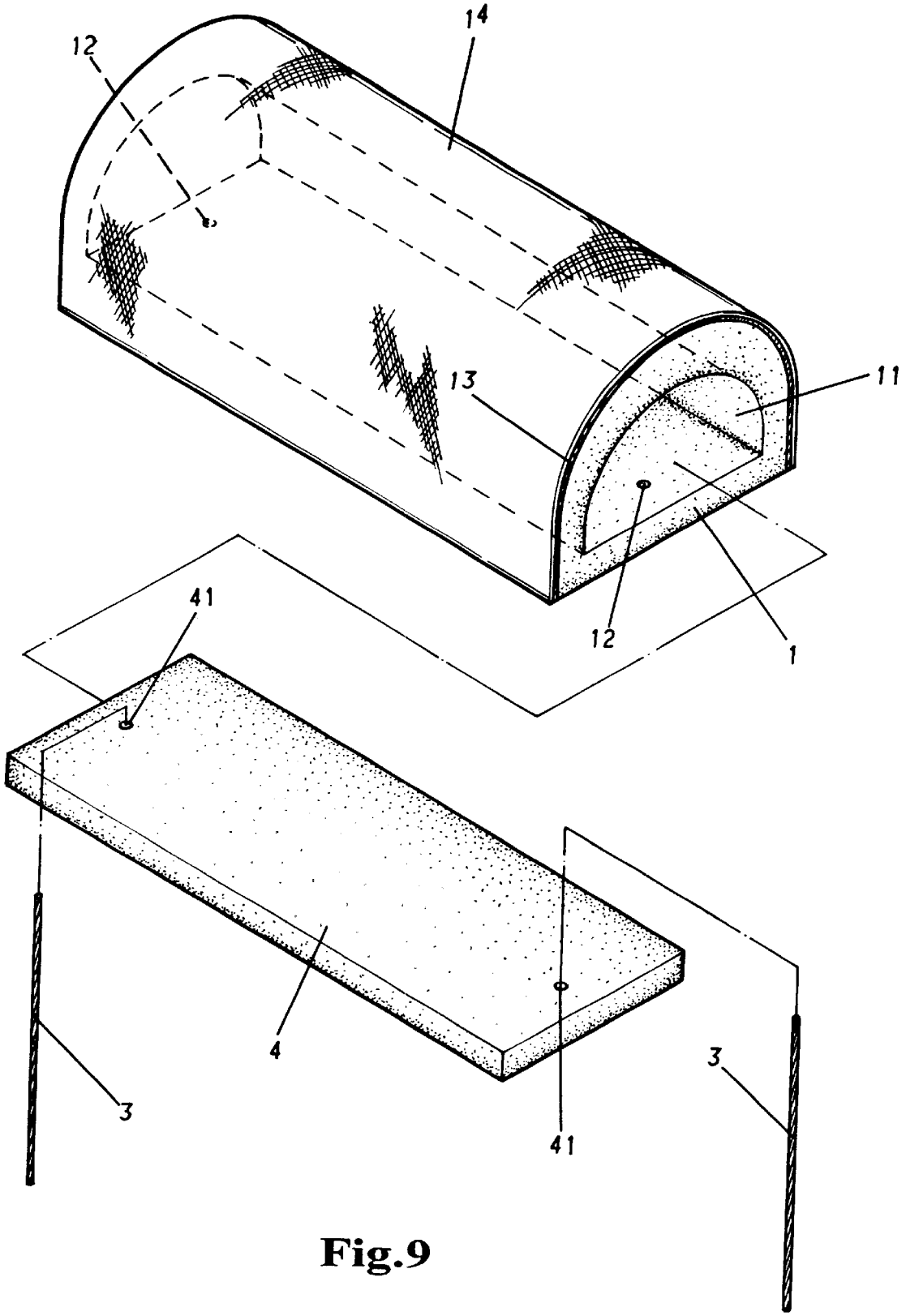
FIG. 9 is an exploded view of a pillow according to a second embodiment of the present invention.

FIGS. 9 and 10 show an alternate form of the pillow according to the present invention. According to this alternate form, a flat support 4 of foamed material is used instead of the aforesaid support 2. The flat support 4 has two through holes 41 corresponding to the through holes 12 of the pillow body 1. The tie cords 3 are respectively fastened to the through holes 41 of the flat support 4 and the through holes 12 of the pillow body 1 to secure the flat support 4 to the pillow body 1 inside the longitudinally extended open chamber 11. According to this design, the top and bottom sides of the flat support 4 are planar surfaces.

Figure 7:
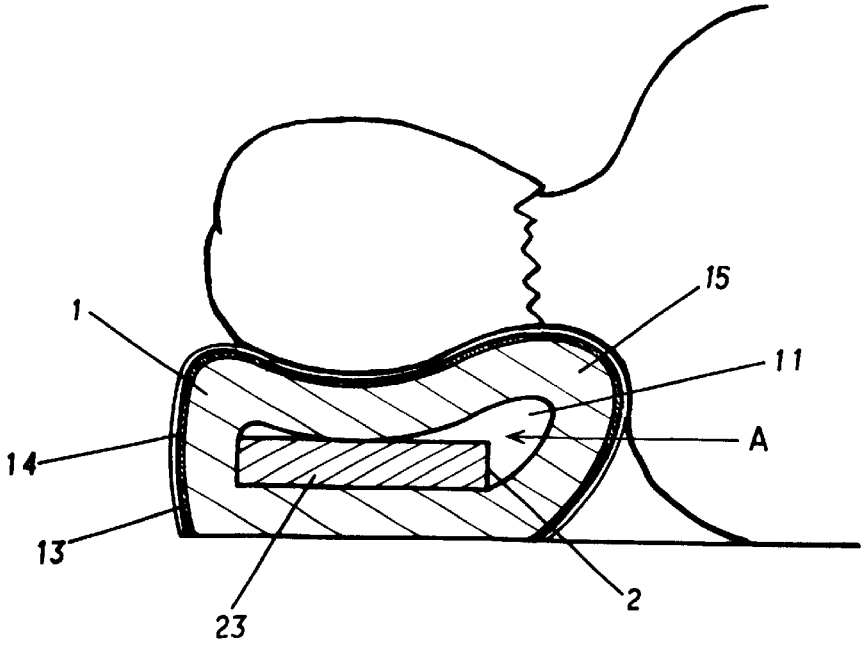
FIG. 7 is a sectional view of FIG. 6 viewed from another direction.

When put the pillow under the head, the open chamber 11 provides a space A for ventilation and dissipation of heat (see FIG. 7).

A prototype of pillow has been constructed with the features of FIGS. 2~10. The pillow functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A pillow comprising a pillow body of sponge, said pillow body having an open chamber of semicircular cross section longitudinally extended through two opposite vertical lateral sides thereof, and a support of foamed plastics inserted into the open chamber of said pillow body and adapted for supporting the pressure of the head resting on said pillow body, said support having a recessed middle support portion, two flat side support portions disposed at two sides of said recessed middle support portion, and two slopes respectively downwardly sloping from said flat side support portions to two sides of said recessed middle support portion.

2. The pillow as claimed in claim 1, wherein said pillow body has two through holes vertically extended through a bottom sidewall thereof adjacent to the two opposite vertical lateral sides of said pillow body; said support has two through holes respectively extended through top and bottom sides of said flat side support portions and adapted for fastening to the through holes of said pillow body by a respective tie cord.

3. A pillow comprising a pillow body of sponge, said pillow body having an open chamber of semicircular cross section longitudinally extended through two opposite vertical lateral sides thereof, and a support of foamed plastics inserted into the open chamber of said pillow body and adapted for supporting the pressure of the head resting on said pillow body, said support having a planar top surface defining with the open chamber of said pillow body a ventilation space.

* * * * *